US011274527B1

(12) United States Patent
Ware et al.

(10) Patent No.: US 11,274,527 B1
(45) **Date of Patent: *Mar. 15, 2022**

(54) COVER GRATE FOR WELL-SITE CELLARS

(71) Applicant: St. Peter Metal Works, LLC, Whitney, TX (US)

(72) Inventors: Joseph Ware, Kopperl, TX (US); Thomas St. Peter, Morgan, TX (US)

(73) Assignee: St. Peter Metal Works, LLC, Whitney, TX (US)

( * ) Notice: Subject to any disclaimer, the term of this patent is extended or adjusted under 35 U.S.C. 154(b) by 187 days.

This patent is subject to a terminal disclaimer.

(21) Appl. No.: 15/825,182

(22) Filed: Nov. 29, 2017

(51) Int. Cl.
*E21B 41/00* (2006.01)

(52) U.S. Cl.
CPC ..... *E21B 41/0021* (2013.01)

(58) Field of Classification Search
CPC ..... E02D 29/1463; E02D 29/1418; E02D 29/1454; E02D 29/02; E02D 29/0266; E02D 29/0233; E02D 29/0225; E02D 29/14; E02D 29/147; E02D 5/80; E21B 41/0021; E21B 17/043; E21B 17/0465; E21B 23/02; E21B 23/00; E21B 3/045; E21B 15/02; E03F 5/06; B66F 19/005; E02B 17/00; B63B 35/44
USPC ..... 210/163, 164, 165
See application file for complete search history.

(56) References Cited

U.S. PATENT DOCUMENTS 3,043,255 A * 7/1962 Bauer ..... E21B 15/02 114/264
3,099,912 A * 8/1963 Wolff ..... E02B 17/027 405/207
3,371,728 A * 3/1968 Crooke ..... E21B 19/002 175/85
6,027,283 A * 2/2000 Schweinberg ..... E01C 11/227 404/4
6,908,256 B1 * 6/2005 Humphries ..... E03F 5/06 404/2
7,637,692 B1 12/2009 Rose
7,879,233 B2 * 2/2011 Shaw ..... E03F 5/0404 210/164
2005/0135902 A1 * 6/2005 Spisak ..... E21B 19/00 414/22.51
2010/0288685 A1 * 11/2010 Meyers ..... E03F 5/0408 210/164

(Continued)

FOREIGN PATENT DOCUMENTS

KR 20090116542 A * 11/2009 ..... E02D 29/1454
RU 2222658 C2 * 1/2004 ..... E01B 29/02

OTHER PUBLICATIONS

Filing Receipt dated Aug. 14, 2018 for corresponding U.S. Appl. No. 16/047,207.

(Continued)

*Primary Examiner* — Claire A Norris
*Assistant Examiner* — Ekandra S. Miller-Cruz
(74) *Attorney, Agent, or Firm* — James E. Walton

(57) ABSTRACT

A system and method for protecting workers, vehicles, and well-heads by enclosing well-site cellars with a series of framed plates. Each plate is perforated and configured for lifting with holes for hoisting the plates. Each plate is lipped to be retained by longitudinal edges of the cellar. A plurality of plates supports a platform for supporting a pipe wrangler adjacent a cellar based wellbore.

8 Claims, 8 Drawing Sheets

(56) References Cited

U.S. PATENT DOCUMENTS

2017/0175374 A1* 6/2017 Funari ..... E03F 5/0401

OTHER PUBLICATIONS

Information Disclosure Statement dated Oct. 10, 2018 for corresponding U.S. Appl. No. 16/047,207.
Office Action dated Oct. 30, 2019 for corresponding U.S. Appl. No. 16/047,207.
Amendment dated Nov. 19, 2019 for corresponding U.S. Appl. No. 16/047,207.
Notice of Publication dated Dec. 31, 2018 for corresponding U.S. Appl. No. 16/047,207.
Final Office Action dated Jan. 10, 2020 for corresponding U.S. Appl. No. 16/047,207.
Amendment After Final dated Feb. 27, 2020 for corresponding U.S. Appl. No. 16/047,207.
Advisory Action dated Mar. 9, 2020 for corresponding U.S. Appl. No. 16/047,207.
Request for Continued Examination dated Apr. 10, 2020 for corresponding U.S. Appl. No. 16/047,207.
Filing Receipt dated Dec. 13, 2017 for related U.S. Appl. No. 15/825,162.
Information Disclosure Statement dated Dec. 21, 2017 for related U.S. Appl. No. 15/825,162.
Request for Corrected Filing Receipt dated Feb. 16, 2018 for related U.S. Appl. No. 15/825,162.
Corrected Filing Receipt dated Feb. 22, 2018 for related U.S. Appl. No. 15/825,162.
Office Action dated Nov. 15, 2018 for related U.S. Appl. No. 15/825,162.
Final Office Action dated Jun. 3, 2019 for related U.S. Appl. No. 15/825,162.
Amendment After Final dated Jul. 24, 2019 for related U.S. Appl. No. 15/825,162.
Advisory Action dated Aug. 30, 2019 for related U.S. Appl. No. 15/825,162.
Request for Continued Examination dated Sep. 3, 2019 for related U.S. Appl. No. 15/825,162.
Notice of Allowance dated Sep. 23, 2019 for related U.S. Appl. No. 15/825,162.
Issue Notification dated Jan. 15, 2020 for related U.S. Appl. No. 15/825,162.
Supplemental Amendment dated May 14, 2020 for corresponding U.S. Appl. No. 16/047,207.
Office Action dated May 27, 2020 for corresponding U.S. Appl. No. 16/047,207.

* cited by examiner

COVER GRATE FOR WELL-SITE CELLARS

BACKGROUND

1. Field of the Invention

The present invention relates generally to cover for oil wells, and more specifically to a cover grate for well-site cellars such as the Cellar Tech containment well cellar having a lip.

2. Description of Related Art

Conventional well sites for hydrocarbon extraction from the ground are flush with or above ground. In order to prevent accidents, some drill sites locate the well head below grade to prevent accidents in a concrete or steel cellar. Well heads below grade are grouped together in a rectangular cellar below the pad site. Conventional systems, if any are used to prevent accidentally falling into the cellars, consist of removable railings that slip into the perimeter of the cellar. These railings are cumbersome to operators as they stick out of the ground. Thus, there exists significant room for improvement in the art for overcoming these and other shortcomings of conventional systems and methods for closing in cellars for oil field operations.

DESCRIPTION OF THE DRAWINGS

The novel features believed a characteristic of the embodiments of the present application is set forth in the appended claims. However, the embodiments themselves, as well as a preferred mode of use, and further objectives and advantages thereof will best be understood by reference to the following detailed description when read in conjunction with the accompanying drawings, wherein:

Figure 1:
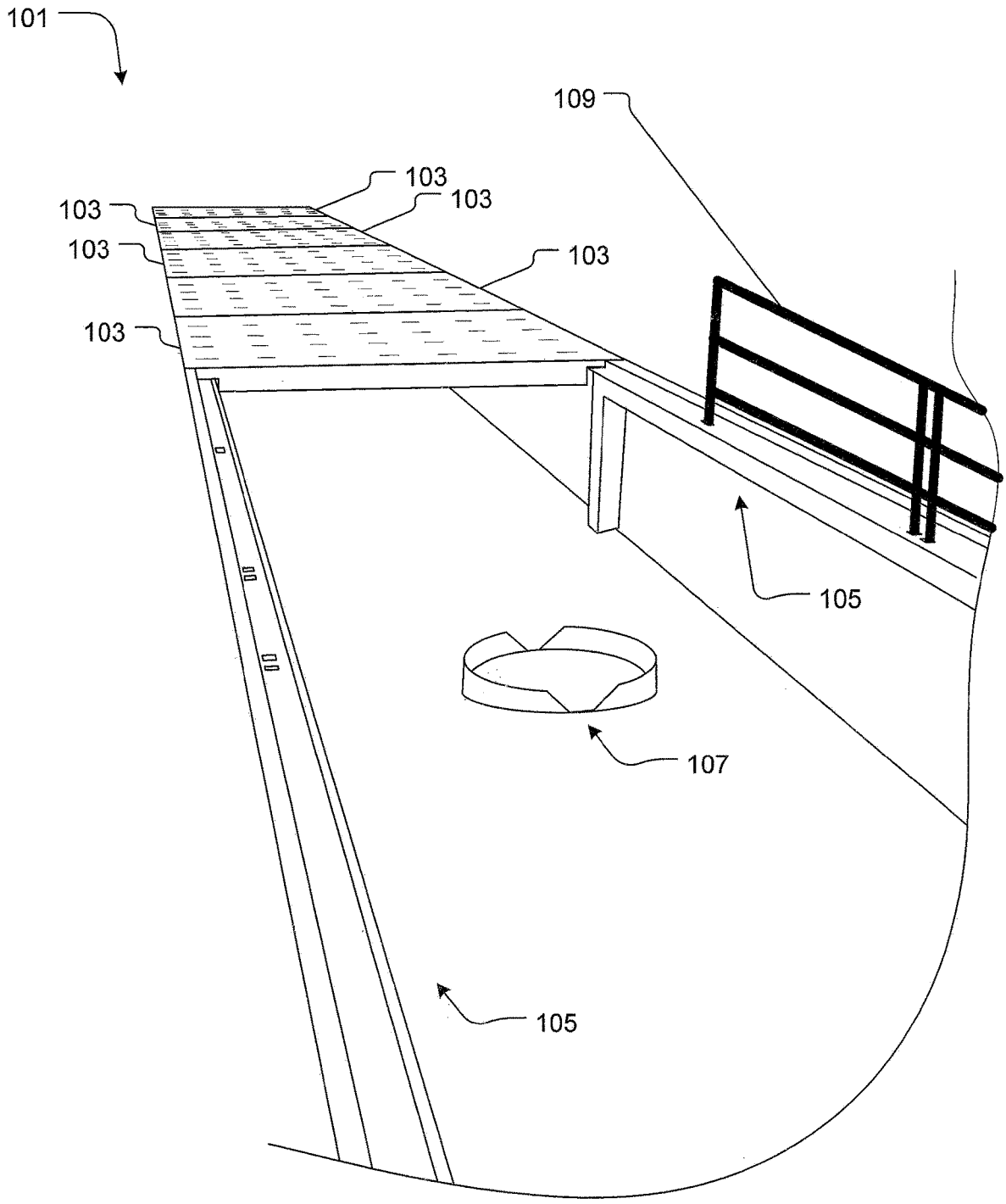
FIG. 1 is a perspective view of a well-site cellar partially covered with grates according to the present application.

While the assembly and method of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the cover grate for well-site cellars are provided below. It will, of course, be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

A cover grate specifically configured for closing out Cellar Tech type cellars provide features not found in conventional covers. Cellar Tech style containment well cellars feature structural reinforcements along with sealed seams preventing migration of fluids from inside the cellar to outside the cellar and vice versa. Furthermore, containment well cellars feature inwardly facing lips near the opening for preventing runoff rainwater and other fluids from entering the opening. The improved cover grating utilizes the lip of the containment well cellar to hold the improved cover grating adjacent the opening.

Referring now to FIG. 1 in the drawings, a preferred embodiment of a plurality of cover grates for well-site cellars according to the present application is illustrated. System 101 is comprised of a plurality of cover grates 103, fabricated of steel, retained by a pair of longitudinal lips 105 of a well-site cellar. The cover grates are located above the cellar and not configured to be located below grade and inside the cellar. Each cover grate is comprised of a perforated top plate supported by a frame. The user can vary the number of cover grates required to close as much of the well site cellar as required to access the well head 107. Conventional fencing 109 is retained by openings in the longitudinal edges 105 of the well-site cellar. Cover grates 103 covers openings in the lips 105 for conventional fencing 109. Each grate of the system is oriented to be parallel to the sides of the cellar so that the grating can translate a length of the cellar depending upon where the cover is required. The cover is structurally designed to support the movement of equipment and personnel around the cellar on the cover grate, however, vehicles are restricted from driving across the plurality of grate covers. Each cover grate is designed to support 1,000/lbs/ft$^2$ evenly distributed across the grate.

Figure 2:
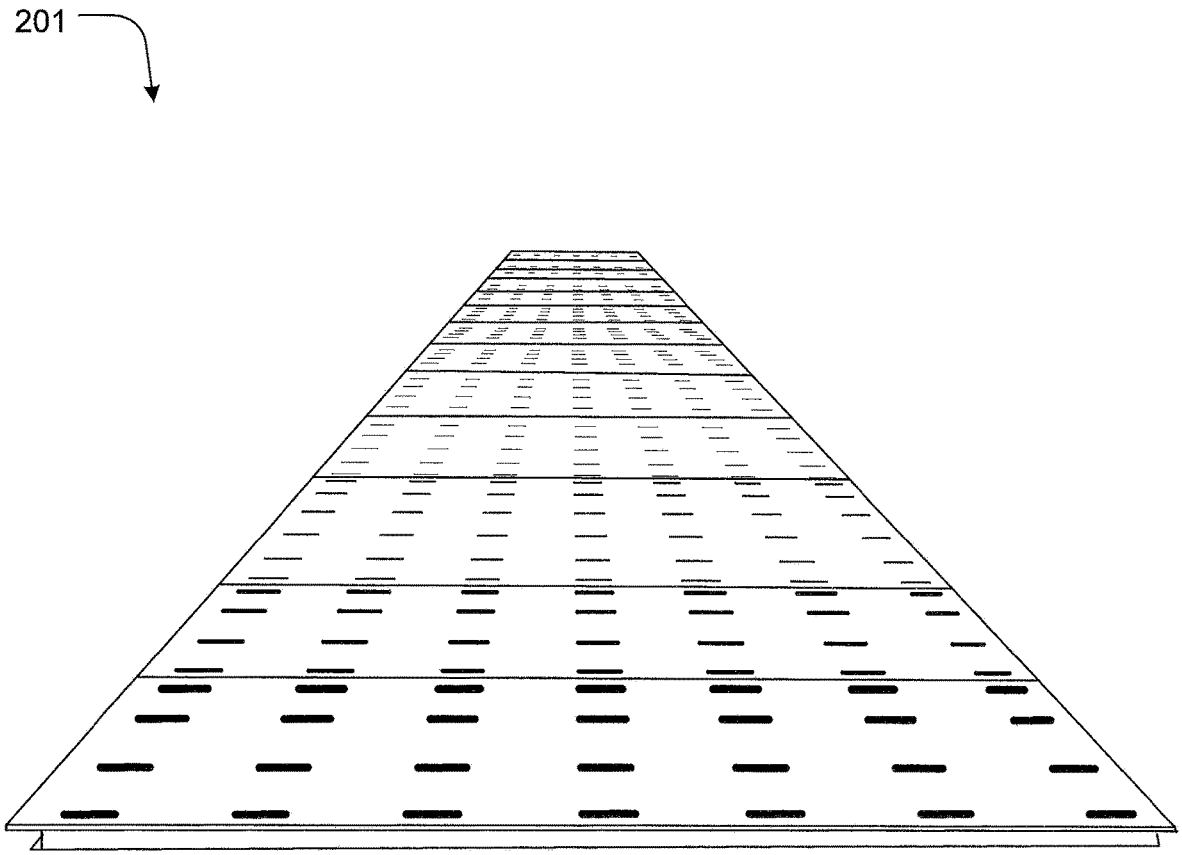
FIG. 2 is a perspective view of a well-site cellar completely covered with grates according to the present application.
Figure 3A:
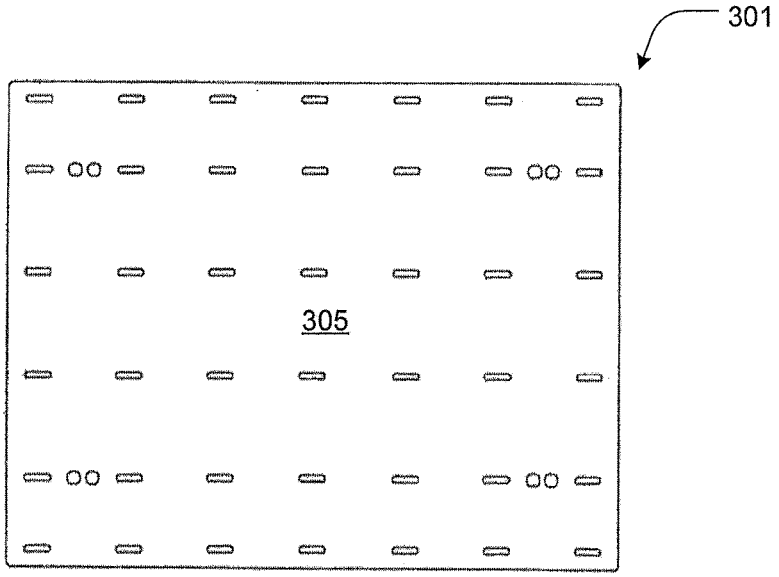
FIG. 3A is a top view of a cover grate for a well site cellar according to the present application.
Figure 3D:
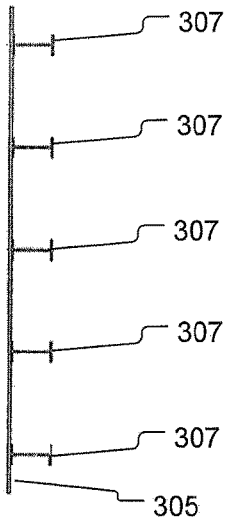
FIG. 3D is a section view along a line IIID of a cover grate for a well site cellar according to the present application.
Figure 3B:
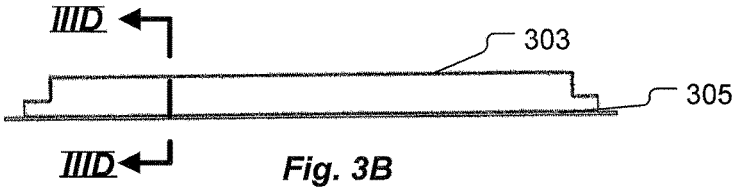
FIG. 3B is a side view of a cover grate for a well site cellar according to the present application.
Figure 3C:
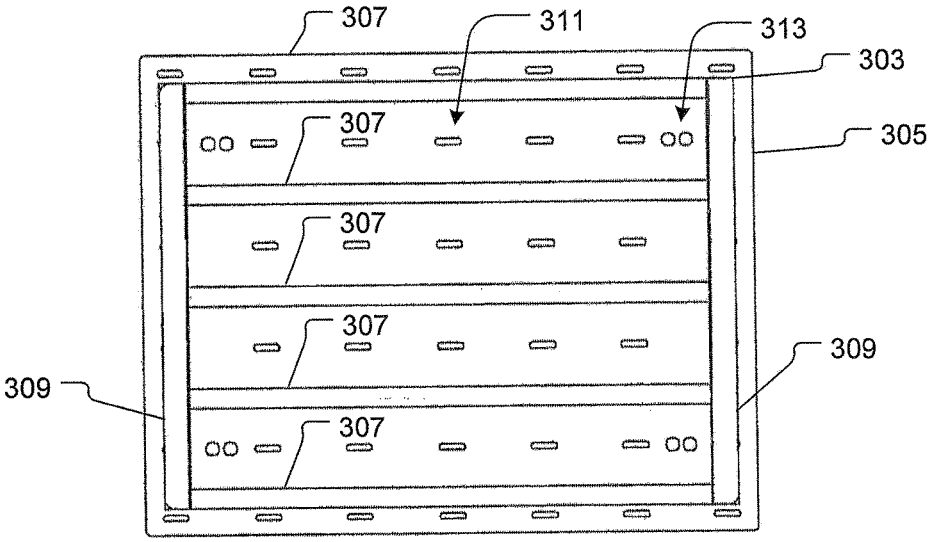
FIG. 3C is a bottom view of a cover grate for a well site cellar according to the present application.
Figure 4A:
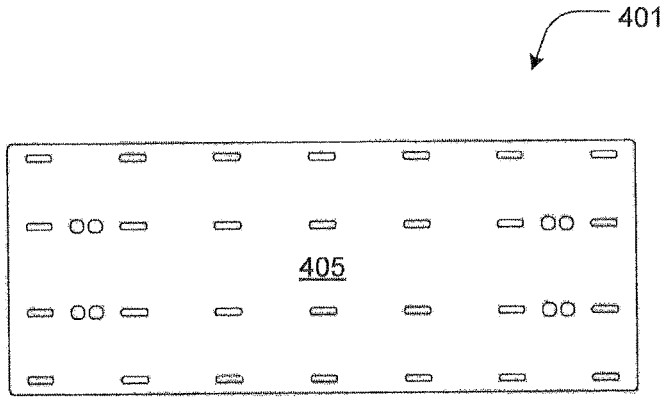
FIG. 4A is a top view of a cover grate for a well site cellar according to the present application.
Figure 4D:
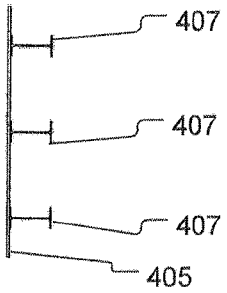
FIG. 4D is a section view along a line IIID of a cover grate for a well site cellar according to the present application.
Figure 4B:
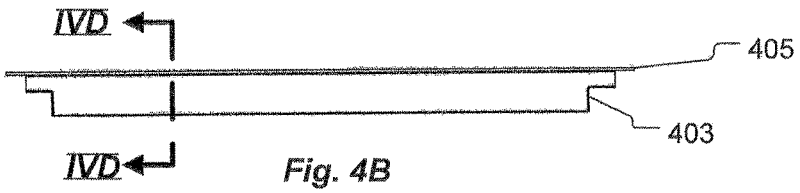
FIG. 4B is a side view of a cover grate for a well site cellar according to the present application.
Figure 4C:
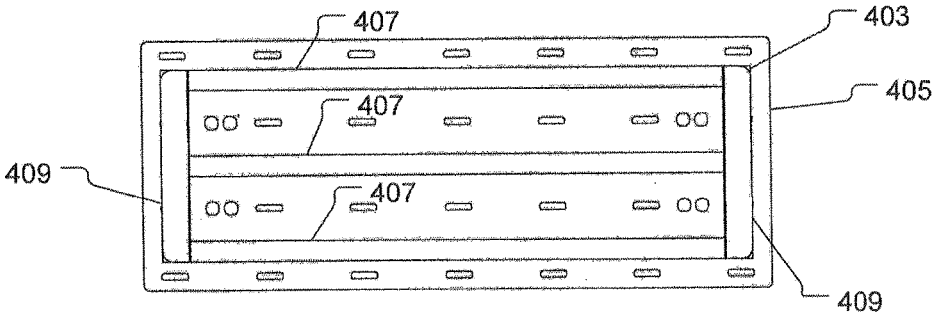
FIG. 4C is a bottom view of a cover grate for a well site cellar according to the present application.

Referring now also to FIG. 2 in the drawings, a preferred embodiment of a plurality of cover grates completely covering a well-site cellar according to the present application is illustrated. System 201 is similar to that of system 101 and further secures the well site by completely covering the well-site cellar from end to end.

Referring now also to FIGS. 3A-3D in the drawings, a preferred embodiment of a cover grate according to the present application is illustrated. Cover grate 301 is comprised of a frame 303 and a plate 305. Preferably plate 305 is welded to frame 303, however other alternative embodiments feature fasteners to rigidly couple the plate and frame together. Frame 303 is comprised of a first plurality of support members 307 and a second plurality of support members 309. The first plurality of support members 307 are spaced across the plate and capped on the ends by the second plurality of support members 309 to form frame 303. Each member of the second plurality of support members 309 is configured to be retained by the longitudinal edges of the cellar by being notched. Notching the second plurality of support members allows the cover to be inserted into the cellar and removed from the cellar by lifting and setting the grating vertically. Alternative embodiments utilize a different profile for the second plurality of support members where the cover is inserted and then horizontally translated into a locked position on the cellar. The first plurality of support members is comprised of a series of evenly spaced I-beams.

Plate 305 is comprised of a first array of openings 311 and a second array of openings 313. The first array of openings 311 are oblong to retain legs of supporting platforms, Furthermore, the first array of openings are configured to allow migration of light, gas, and liquids from a top of the cover to the contents of the cellar. While illustrated as the cover being mostly solid, it should be apparent that the cover grate 301 alternatively be mostly perforated and open between above and below the cover grate. The second array of openings 313 are pairs of collocated circular openings configured to allow the grate to be picked up and lowered by a chain and/or a hook.

Referring now also to FIGS. 4A-4D in the drawings, an alternative embodiment of a cover grate according to the present application is illustrated. Cover grate 401 is comprised of a frame 403 and a plate 405. Frame 403 is comprised of a first plurality of support members 407 and a second plurality of support members 409. Cover grate 401 is shorter in length than cover grate 301 and provides users with more flexibility to cover well-site cellars.

Figure 5A:
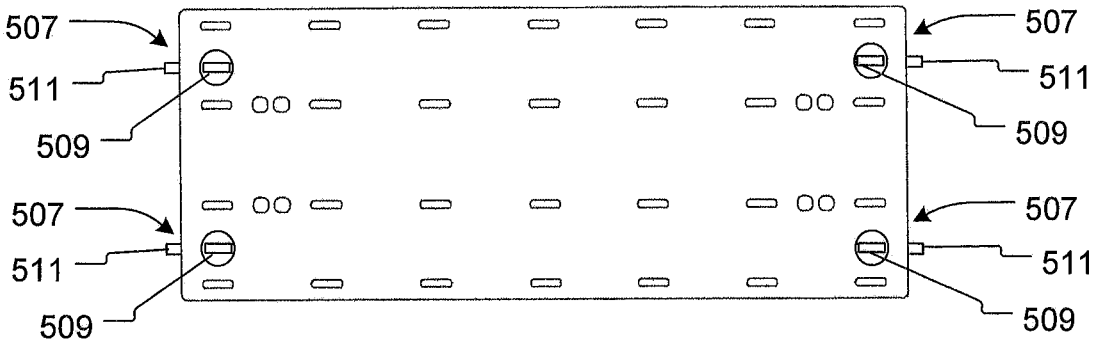
FIG. 5A is a top view of an alternative cover grate for a well site cellar according to the present application.
Figure 5B:
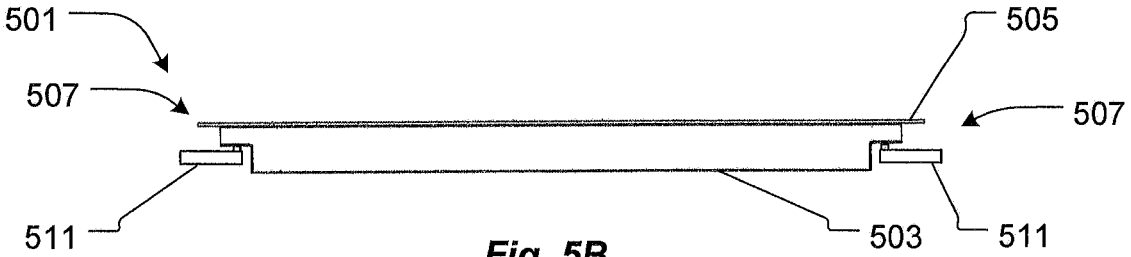
FIG. 5B is a side view of an alternative cover grate fora well site cellar according to the present application.

Referring now also to FIGS. 5A-5B in the drawings, an alternative embodiment of a cover grate according to the present application is illustrated. Cover grate 501 is comprised of a frame 503, a plate 505, and locking members 507. Locking members 507 is comprised of a recessed handle 509 accessible from the top of the grate after installation and a pivoting member 511 rotationally coupled to the handle 509. Once the cover grate 501 is installed on the cellar, the user rotates handles 509 thereby rotating pivoting members underneath a lip or edge of the cellar. The pivoting member being under the edge of the cellar prevents the grating from being lifted. Alternative cover grate 501 further comprises a plurality of fasteners for positively retaining the grates to the lips of the cellar. Furthermore, alternative embodiments of the grating feature manholes covers, ladders, and lighting for access above and below the cover grate.

Figure 6:
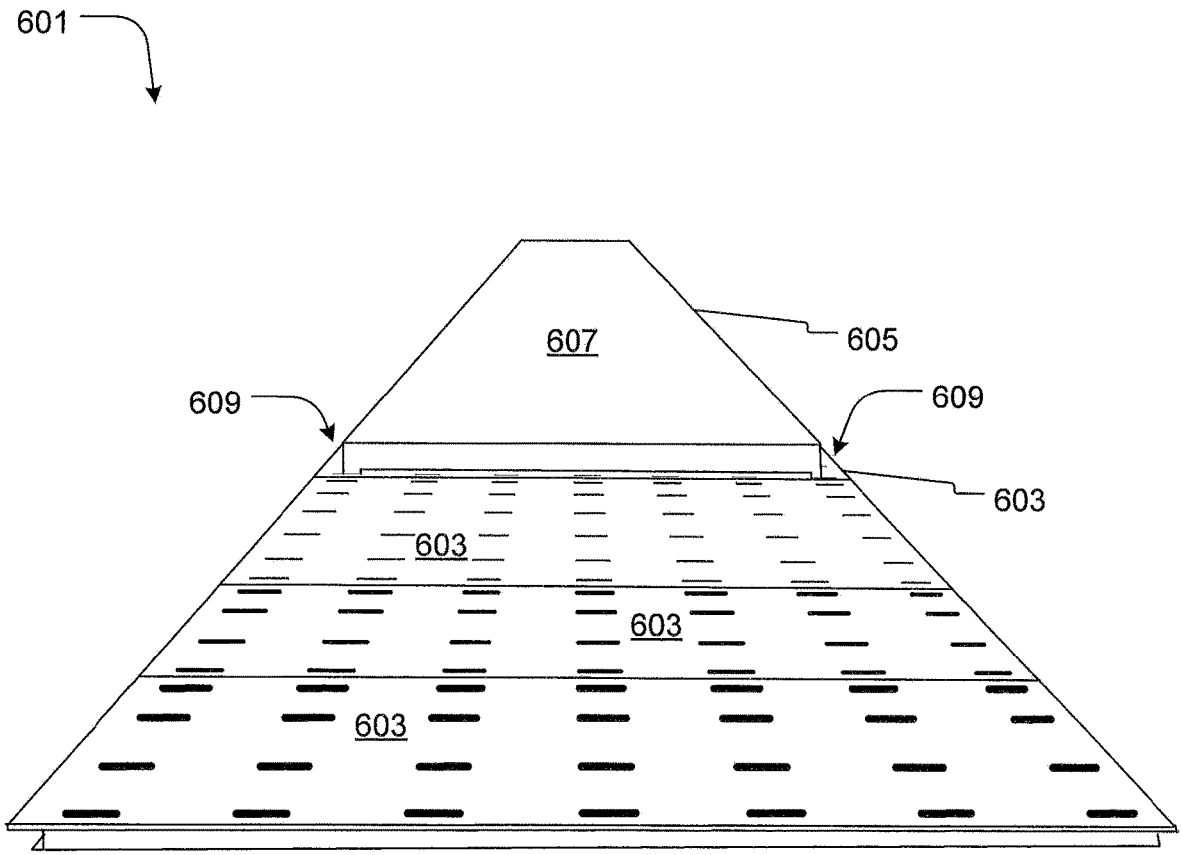
FIG. 6 is a perspective view of a well-site cellar completely covered with grates supporting a platform for a pipe wrangler according to the present application.

Referring now also to FIG. 6 in the drawings, a preferred embodiment of a plurality of cover grates completely covering a well-site cellar according to the present application is illustrated. System 601 is similar to that of system 201 and further secures the well site by completely covering the well-site cellar from end to end. System 601 is comprised of a plurality of grate covers 603 supporting a platform 605 for a pipe wrangler (not shown). The platform 605 is comprised of a flat upper plate 607 and a plurality of legs 609 having an oblong profile. Each of the legs 609 is received by an oblong opening in the grate covers. Platform 605 is moved by a crane by strapping underneath the flat upper plate 607. Alternatively, platform 605 further comprises a plurality of lifting points arrayed across the top of the platform.

The platform 605 is rigidly retained by the grate covers 603 thereby translation between the grate covers and the platform 605 is inhibited. Furthermore, translation between the platform 605 and the ground is inhibited because the grate covers 603 are retained by the lips of the cellar. The platform being retained by the grate covers is assisted by the friction associated with the platform weighing several thousand pounds.

Figure 7:
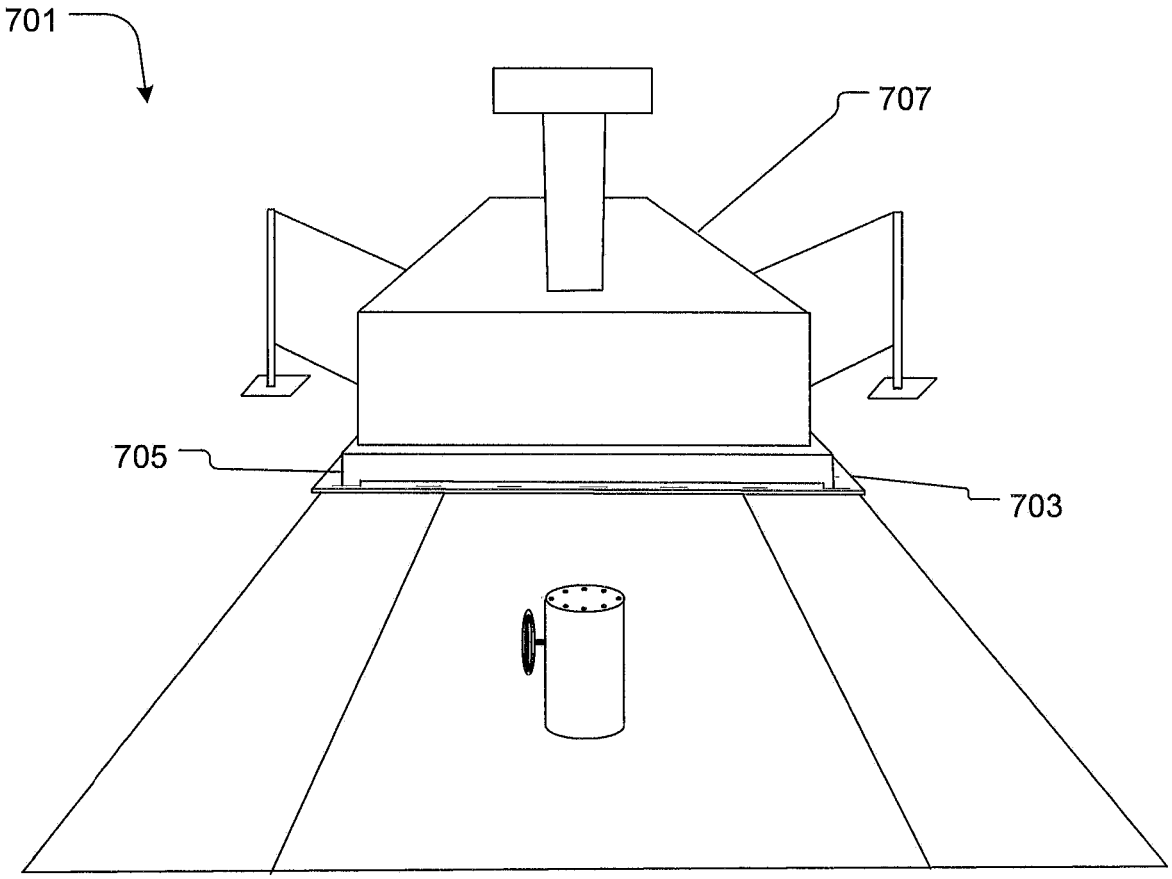
FIG. 7 is a perspective view of a well-site cellar partially covered with grates supporting a platform for a pipe wrangler according to the present application.

Referring now also to FIG. 7 in the drawings, a preferred embodiment of a plurality of cover grates partially covering a well-site cellar according to the present application is illustrated. System 701 is similar to that of system 601 and further secures the well site by partially covering the well-site cellar while leaving an opening for a well head christmas tree. System 701 is comprised of a plurality of grate covers 703 supporting a platform 705 for a pipe wrangler 707.

Figure 8:
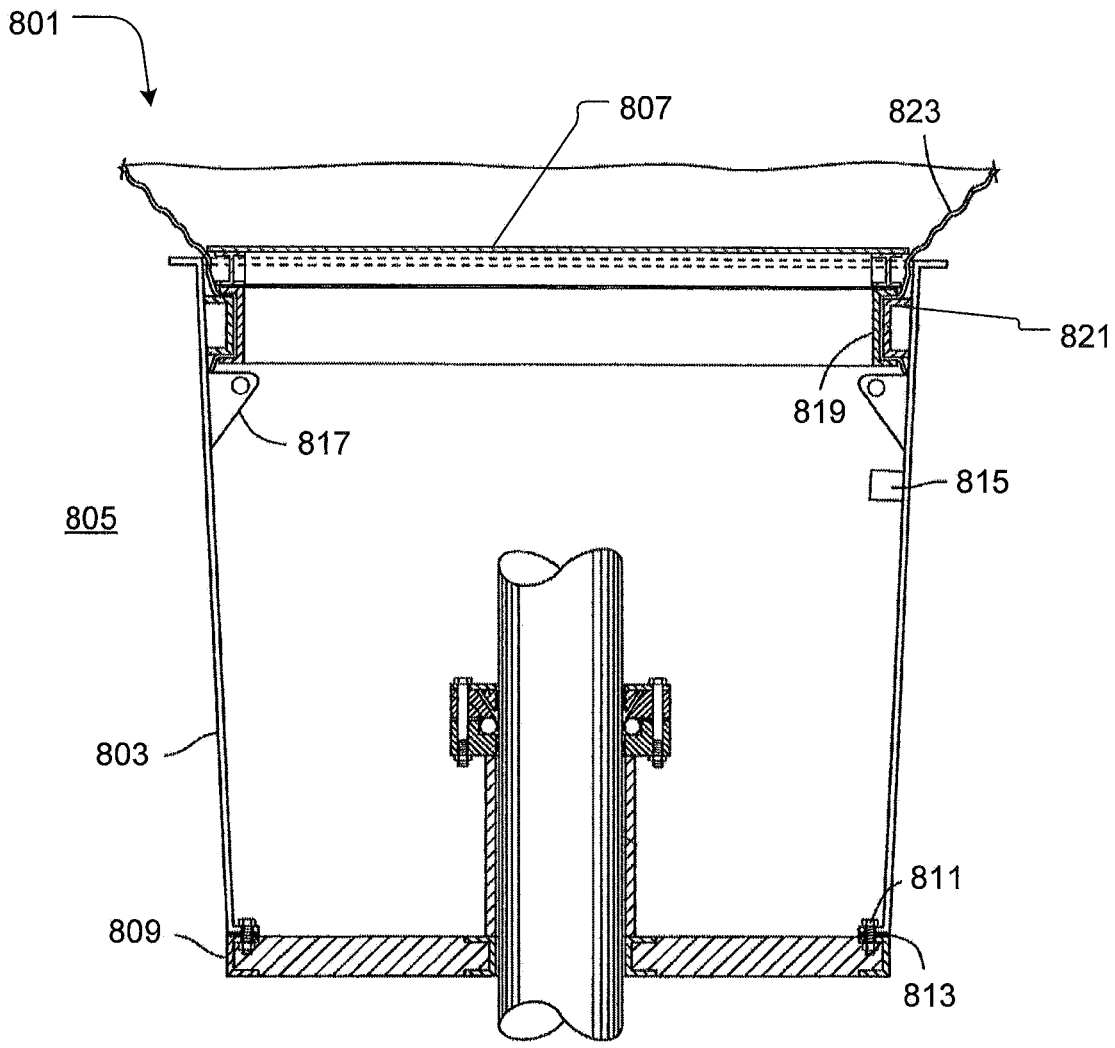
FIG. 8 is a section view of a well-site cellar covered with a cover grate.

Referring now also to FIG. 8 in the drawings, an alternative embodiment of a cover grates covering a well-site cellar according to the present application is illustrated. System 801 is comprised of a Cellar Tech type containment well cellar 803 sunken into the ground 805 and a grate cover 807. While the illustrated as a cellar that is assembled on site, it should be apparent that the improved cellar grates may be used with a preassembled containment cellar that is trucked to the well site and hoisted into place. Cellar 803 is comprised a plurality of sides coupled to a bottom 809 by fasteners 811 with a seal 813 between the plurality of sides and the bottom 809. Furthermore, high water sensor 815 is located on a side of the cellar 803 and allows users to monitor for high water. Gussets 817 are located around the cellar 803 and allow the cellar to be hoisted by a crane. Grate cover 807 rests on top of a hoop 819 and a lip 821 that retains a liner 823. Alternatively, the system 801 doesn't use a liner 823 and doesn't have a hoop 819 such that the grate cover 807 rests directly on top of the lip 821.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments but are amenable to various changes and modifications without departing from the spirit thereof.

What is claimed is:

1. A cover grate system for a well-site cellar, comprising: a plurality of perforated plates configured for placement over a lip of the well-site cellar, each perforated plate having a plurality of non-mesh, enclosed apertures and a frame with a first plurality of support members in a first orientation and a second plurality of support members in a second orientation; and a platform for a pipe wrangler, configured to support movement of heavy equipment and supported by the plurality of perforated plates; at least one rigid leg extending down from the platform and through the enclosed aperture, such that the platform does not translate relative to the plate; wherein the platform rests on the plurality of perforated plates; wherein the at least one rigid leg is of a fixed length and is configured to fit into at least one of the plurality of non-mesh, enclosed apertures, such that the platform is rigidly retained by the plurality of perforated plates, the platform remaining substantially stationary relative to the plurality of perforated plates; wherein a respective aperture of the plurality of non-mesh, enclosed apertures is enclosed relative to a perimeter of the respective aperture; and wherein the at least one rigid leg is not height-adjustable and do not extend down to the bottom of the well-site cellar when the platform is within the enclosed apertures.

2. The cover grate system according to claim 1, each of the plurality of plates comprising:

a locking member configured to positively retain the plate to a lip of the well-site cellar;

wherein the locking member comprises a recessed handle and a pivoting member.

3. The cover grate system according to claim 1, each of the plurality of perforated plates further comprising:

a plurality of perforations having a circular shape;

wherein the plurality of enclosed apertures have an oblong shape configured for retaining the at least one rigid leg of the platform; and wherein the at least one rigid leg is integral to the platform.

4. A cover grate system for a well-site cellar, comprising: a first perforated plate configured for placement over a lip of a well cellar having a first plurality of enclosed openings configured to retain a first rigid leg of a platform for a pipe wrangler; a second perforated plate configured for placement over a lip of the well-site cellar having a second plurality of enclosed openings configured to retain a second rigid leg of the platform; and wherein the platform is configured to support movement of heavy equipment and spans the first plate and the second plate; and wherein the first rigid leg and second rigid leg of the platform are of a fixed length, are not height-adjustable, do not extend down to the bottom of the well-site cellar when the first rigid leg and the second rigid leg of the platform are within the enclosed openings, are removably set within the enclosed openings of the first plate and the second plate, and are immobilized along a plane parallel to the first plate and the second plate, such that the platform is rigidly retained and the platform does not move relative to the first plate and the second plate; wherein the first plate and the second plate each have a frame with a first plurality of support members in a first orientation and a second plurality of support members in a second orientation; and wherein an opening of the first plurality of enclosed openings and the second plurality of enclosed openings is enclosed relative to a perimeter of the opening.

5. The cover grate system according to claim 4, wherein the first plurality of enclosed openings and the second plurality of enclosed openings are oblong.

6. The cover system according to claim 5, wherein the first rigid leg and the second rigid leg have an oblong profile to fit respectively within the oblong openings.

7. The cover system according to claim 4, further comprising:

an array of circular openings to provide lifting access for a hook or a chain.

8. The cover system according to claim 7, wherein the array of circular openings are collocated.

* * * * *